US008939542B2

(12) United States Patent
Govyadinov et al.

(10) Patent No.: US 8,939,542 B2
(45) Date of Patent: Jan. 27, 2015

(54) DETECTING DEFECTIVE NOZZLES

(71) Applicant: Hewlett-Packard Development Company, L.P., Houston, TX (US)

(72) Inventors: Alexander Govyadinov, Corvallis, OR (US); Clayton L. Holstun, San Marco, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/925,517

(22) Filed: Jun. 24, 2013

(65) Prior Publication Data

US 2014/0375718 A1 Dec. 25, 2014

(51) Int. Cl.
*B41J 29/393* (2006.01)
*B41J 2/045* (2006.01)

(52) U.S. Cl.
CPC ..... *B41J 2/0456* (2013.01)
USPC ..... 347/19

(58) Field of Classification Search
USPC ..... 347/19, 40
See application file for complete search history.

(56) References Cited

U.S. PATENT DOCUMENTS

| | | | | |
|---|---|---|---|---|
| 4,990,932 | A | 2/1991 | Houston | |
| 5,434,430 | A | 7/1995 | Stewart | |
| 6,513,901 | B1 | 2/2003 | Walker | |
| 6,752,483 | B1 | 6/2004 | Vega et al. | |
| 2004/0095410 | A1 * | 5/2004 | Miyashita | 347/19 |
| 2007/0024658 | A1 | 2/2007 | Diol et al. | |

OTHER PUBLICATIONS

Wijshoff, H. et al.; "Structure-and Fluid-Dynamics in Piezo Inkjet Printheads"; Dec. 20, 2007; http://doc.utwente.nl/58366/1/thesis_Wijshoff.pdf.

* cited by examiner

*Primary Examiner* — Stephen Meier
*Assistant Examiner* — Sharon A Polk
(74) *Attorney, Agent, or Firm* — Van Cott, Bagley, Cornwall & McCarthy; Steven L. Nichols

(57) ABSTRACT

A method of detecting a defective nozzle within a nozzle array, may comprise grouping each nozzle with a number of other nozzles within the nozzle array, measuring fluid output from each group of nozzles with a fluid detector, individually regrouping each nozzle within a group of nozzles whose fluid output is detected as not being commensurate with the amount of fluid that should be ejected from that group with a number of known non-defective nozzles to form a number of subsequent groups, and measuring fluid output from the subsequent groups of nozzles to determine which nozzle among the subsequent groups of nozzles is defective.

18 Claims, 4 Drawing Sheets

DETECTING DEFECTIVE NOZZLES

BACKGROUND

On occasion, fluid printheads may include a number of nozzles that are failing or have faded such that fluid ejection from the nozzle has been significantly reduced. As a result, any resulting image or deposition on the media by the associated printing device may include significant defects in the resulting image or deposition. This results in an inferior product and user dissatisfaction.

BRIEF DESCRIPTION OF THE DRAWINGS

The accompanying drawings illustrate various examples of the principles described herein and are a part of the specification. The examples do not limit the scope of the claims.

Throughout the drawings, identical reference numbers designate similar, but not necessarily identical, elements.

DETAILED DESCRIPTION

Figure 1:
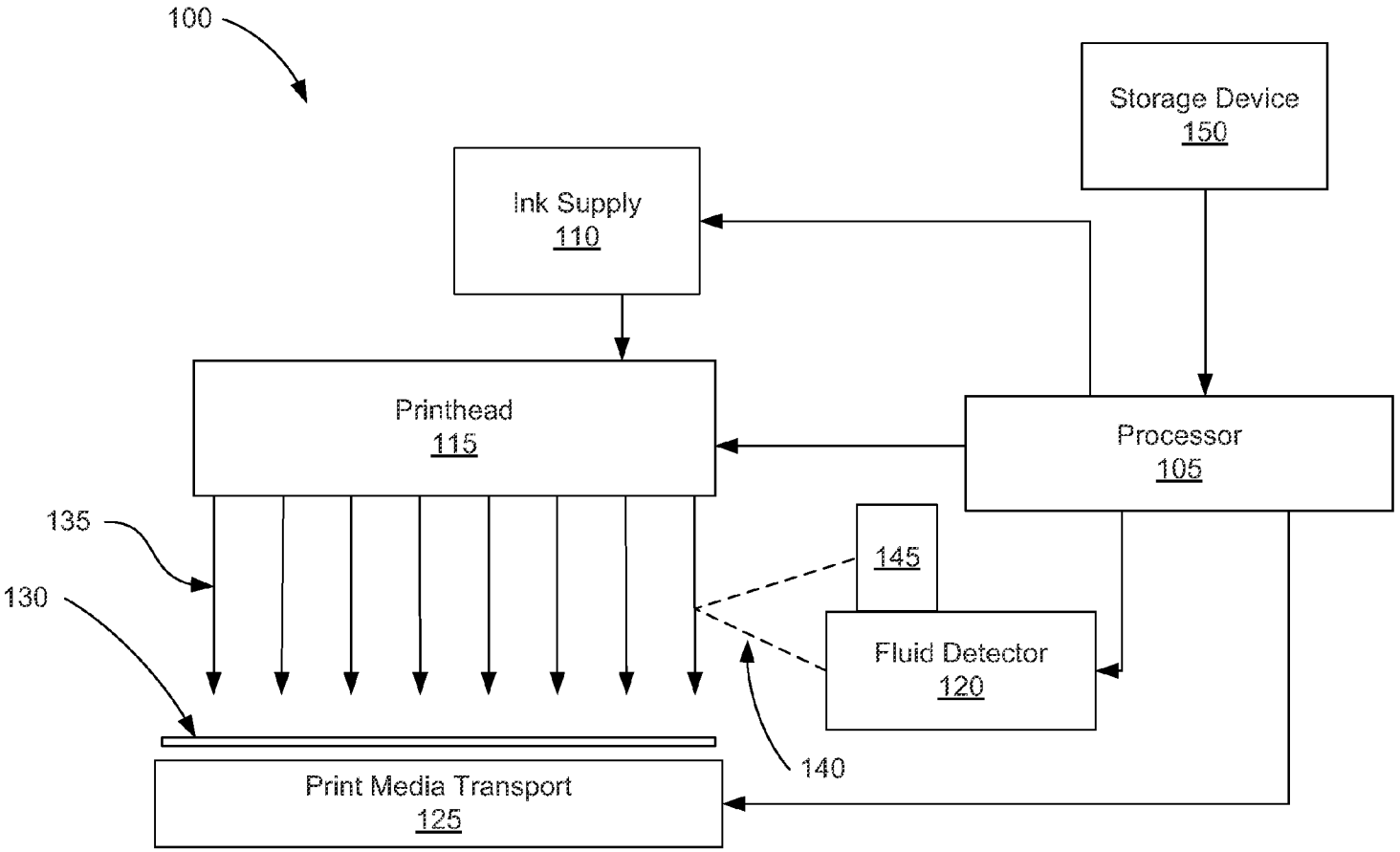
FIG. 1 is block diagram of a printing system according to one example of principles described herein.

Printhead nozzles may eject relatively small amounts of ink droplets sometimes having a diameter as small as 20 microns. The relatively small size of the droplets may result in difficulties in detecting whether a proper amount of ink is being ejected from any single nozzle. Consequently, it may be further difficult to determine which nozzles, if any, among the number of nozzles is not ejecting a proper or threshold amount of ink.

In some examples, the amount of ink ejected from the ink printhead may be detected by an electrical or optical detection system. These systems may be used to detect certain threshold amounts of ink. However, as higher resolution printouts are more desirable, nozzles are being developed that eject smaller amounts of ink. These ink droplet detection systems may not be able to detect such small amounts of ink.

The present specification therefore describes a method of detecting a defective nozzle within a nozzle array, the comprising grouping each nozzle with a number of other nozzles within the nozzle array, measuring fluid output from each group of nozzles with a fluid detector, individually regrouping each nozzle within a group of nozzles whose fluid output is detected as not being commensurate with the amount of fluid that should be ejected from that group with a number of non-defective nozzles to form a number of subsequent groups, and measuring fluid output from the subsequent groups of nozzles to determine which nozzle among the subsequent groups of nozzles is defective.

The present specification also describes a method of detecting a defective nozzle associated with a printing system comprising, within a nozzle array, grouping each nozzle with a number of other nozzles, firing fluid droplets from a first group of nozzles, measuring fluid output from the first group of nozzles, determining whether fluid output from the first group of nozzles is commensurate with the amount of fluid that should be ejected from the first group, and when it has been determined that fluid output from the first group of nozzles is not commensurate with the amount of fluid that should be ejected from the first group regrouping each nozzle within the first group of nozzles with a number of non-defective nozzles to form a number of regrouped nozzle groups, firing ink droplets from each regrouped nozzle groups, measuring ink output from the regrouped nozzle groups, and determining which nozzle within the regrouped nozzle groups is defective.

Still further the present specification a computer program product for detecting defective nozzles within a nozzle array, the computer program product comprising a computer readable storage medium comprising computer usable program code embodied therewith, the computer usable program code comprising computer usable program code to, when executed by a processor, group each nozzle with a number of other nozzles within the nozzle array, computer usable program code to, when executed by a processor, measure fluid output from each group of nozzles with a fluid detector, computer usable program code to, when executed by a processor, individually regroup each nozzle within a group of nozzles whose fluid output is detected as not being commensurate with the amount of fluid that should be ejected from that group with a number of non-defective nozzles to form a number of subsequent groups, and computer usable program code to, when executed by a processor, measure fluid output from the subsequent groups of nozzles to determine which nozzle among the subsequent groups of nozzles is defective.

In the present specification and in the appended claims the term "fluids" is meant to be understood as any liquid that can be ejected from a printhead nozzle. Therefore, a fluid may include ink, primer, overcoat, chemical reagent, pharmaceuticals, and liquid gas, among others.

Even still further, as used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language indicates that a particular feature, structure, or characteristic described in connection with that example is included as described, but may not be included in other examples.

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general purpose computer, special purpose computer, or other programmable data processing apparatus to produce a machine, such that the computer usable program code, when executed via, for example, the processor (FIG. 1, 105) of the printing system (FIG. 1, 100) or other programmable data processing apparatus, implement the functions or acts specified in the flowchart and/or block diagram block or blocks. In one example, the computer usable program code may be embodied within a computer readable storage medium; the computer readable storage medium being part of the computer program product.

Turning now to FIG. 1, a block diagram of a printing system (100) according to one example of the principles described herein. The printing system (100) may comprise a processor (105), an ink supply (110), a printhead (115), a fluid detector (120), and a print media transport (125). Each of these will now be described in more detail.

The processor (105) may execute computer code so as to control some or all of the hardware and software used in the printing system (100). Specifically, the processor (105) may operate the ink supply (110) to determine an ink level. Additionally, the processor (105) may direct signals to be sent to the printhead (115) so as to cause ink to be ejected from a number of nozzles associated with the printhead (115). Still further, the processor (105) may control, via sent signals, the movement of the print media transport (125) so as to transport a media under the printhead (115). Even further, the processor (105) may control the fluid detector (120) so as to detect an amount of ink ejected from any nozzle or nozzles associated with the printhead (115). In one example, the processor (105) may coordinate all of these devices (110, 115, 120, 125) so as to cause the printhead (115) to print an image on print media (130). In another example, the processor (105) may coordinate all of these devices (110, 115, 120, 125) so as to cause a nozzle failure detector procedure to be implemented as will be described in more detail below.

The ink supply (110) may provide the printing system (100) with a supply of ink. Although FIG. 1 shows that the fluid used in the system (100) is ink, alternative fluids may also be used and the present specification contemplates the use of these fluids. For convenience of explanation, however, ink will be used in describing the system. In one example, instead of ink, a liquid gas may be supplied as the ink supply (110). In another example, a pharmaceutical may be supplied as the ink supply (110).

The printhead (115) may be any type of printhead that is capable of ejecting an ink onto a substrate. In one example, the printhead may comprise a piezoelectric device capable of ejecting a fluid out of a nozzle. In another example, the printhead may comprise a heating device, that when fired, ejects ink from a number of nozzles. The nozzles associated with the printhead (115) may include any number of nozzles. In one example the number of nozzles may be enough to fit across an entire sheet of media (130) in a page wide array (PWA).

Figure 2:
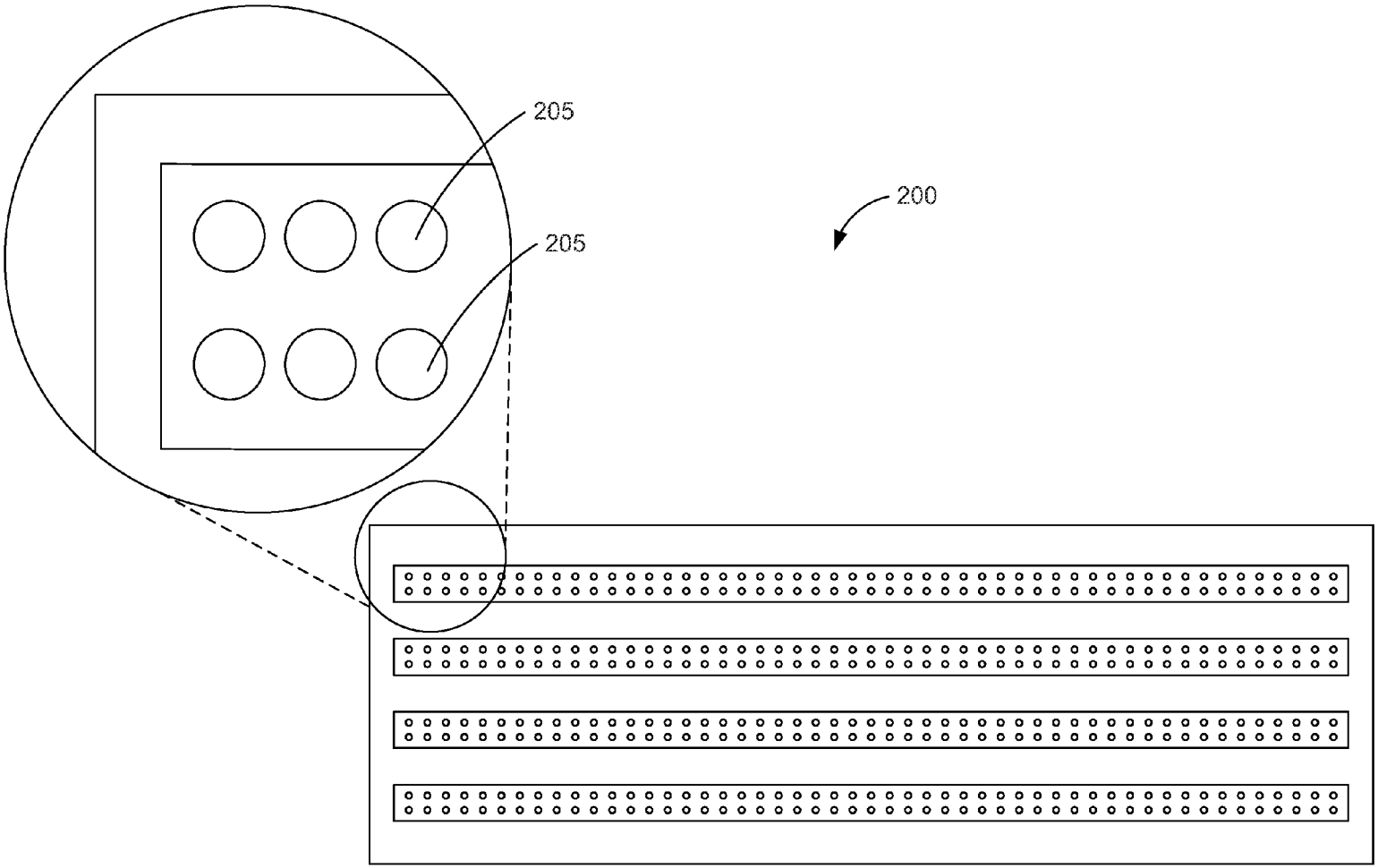
FIG. 2 is a block diagram of a printhead nozzle array according to one example of principles described herein.

As discussed the printhead (115) may comprise a number of nozzles (205). FIG. 2 is a block diagram of a printhead nozzle array (200) according to one example of principles described herein. The nozzle array (200) may comprise any number of nozzles as described above. In one example, the nozzles (205) may be associated with a nozzle number and the nozzle number may be stored in a storage device (150) to be accessed by the processor (105) when the processor has received instructions to initiate a nozzle failure detector procedure. Although FIG. 2 shows a number of columns and rows of nozzles (205) within the nozzle array (200) as being substantially parallel, other configurations may exist. Thus, in one example, a column of nozzles (205) may be relatively offset from another column of nozzles (205) either vertically or horizontally along the 2-dimensional plane created by the bottom of the printhead (FIG. 1, 115). In another example, a row of nozzles (205) may be relatively offset from another row of nozzles (205) either vertically or horizontally along the 2-dimensional plane created by the bottom of the printhead (FIG. 1, 115).

Turning back to FIG. 1, the print media transport (125) transports a sheet of media under the printhead (115) so that the media (130) may receive the ink onto it. In one example, the print media transport (125) may be a number of rollers.

The storage device (150) may store data such as executable program code that is executed by the processor (105) or other processing device. The data storage device (150) may specifically store a number of applications or computer usable program code that the processor (150) executes to implement at least the functionality described herein.

The data storage device (150) may include various types of memory modules, including volatile and nonvolatile memory. For example, the data storage device (150) of the present example includes Random Access Memory (RAM), Read Only Memory (ROM), flash Solid State Drive (SSD) and Hard Disk Drive (HDD) memory. Many other types of memory may also be utilized, and the present specification contemplates the use of many varying type(s) of memory in the data storage device (150) as may suit a particular application of the principles described herein. In certain examples, different types of memory in the data storage device (150) may be used for different data storage needs. For example, in certain examples the processor (105) may boot from Read Only Memory (ROM), maintain nonvolatile storage in the Hard Disk Drive (HDD) memory, and execute program code stored in Random Access Memory (RAM).

Generally, the data storage device (150) may comprise a computer readable storage medium. For example, the data storage device (150) may be, but not limited to, an electronic, magnetic, optical, electromagnetic, infrared, or semiconductor system, apparatus, or device, or any suitable combination of the foregoing. More specific examples of the computer readable storage medium may include, for example, the following: an electrical connection having a number of wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device. In another example, a computer readable storage medium may be any non-transitory medium that can contain, or store a program for use by or in connection with an instruction execution system, apparatus, or device.

The fluid detector (120) may be any device to detect the amount of ink or other fluid ejected from the number of nozzles. In one example, a backscattering fluid detector often called a backscatter drop detect, or BDD. BDD may be used as the fluid detector (120) to detect the ink droplets (135). A BDD is an optical device that shines an electromagnetic wave (140) such as light towards an ink droplet (135). The BBD further includes a light detector (145) that detects any light that is reflected from the ink droplets (135). The detector (145) of the fluid detector (120) may then convert the detected light into a signal representing the amount of light received at the detector (145). This allows a printing device to determine how much ink is being ejected from the nozzle and if the nozzle is defective in any way.

However, one disadvantage of the BDD is that, as the size of the ink droplets (135) get smaller due to advances in printhead technology, the amount of light reflected off of the droplets (135) is diminished. In addition to this disadvantage of the BDD, when the printhead nozzles are ejecting black ink the detectors (145) in the BDDs have an even greater diminished ability to detect light reflected off of the droplets (135). This is because black ink absorbs a relatively larger amount of light available in the light spectrum and does not reflect it back to the detector (145).

Figure 3:
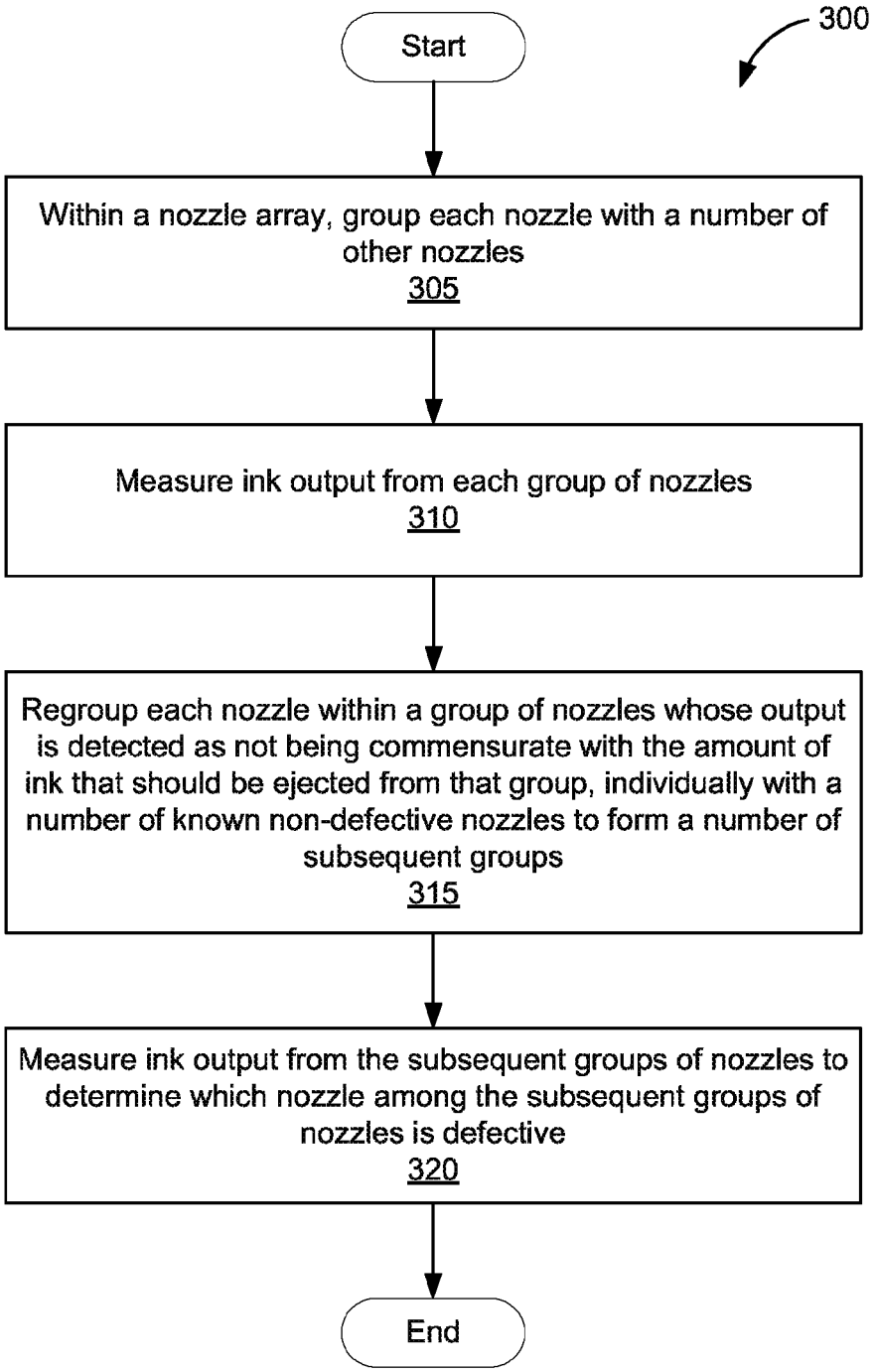
FIG. 3 is a flowchart showing a method of detecting a defective nozzle according to one example of principles described herein.

FIG. 3 is a flowchart showing a method (300) of detecting a defective nozzle according to one example of principles described herein. The method (300) may begin with grouping (305) each nozzle (FIG. 2, 205) with a number of other nozzles (FIG. 2, 205) within a nozzle array (FIG. 2, 200). The group of nozzles (FIG. 2, 205) may consist of any number of nozzles (FIG. 2, 205) equal to or greater than 2. Therefore, in one example, the group of nozzles (FIG. 2, 205) may comprise two individual nozzles (FIG. 2, 205) grouped together by the processor (FIG. 1, 105). In another example, the group of nozzles (FIG. 2, 205) may consist of three nozzles (FIG. 2, 205) again, grouped by the processor (FIG. 1, 105). Larger groups of nozzles (FIG. 2, 205) may also exist and the present specification contemplates the use of those larger groups.

The method (300) may continue by firing ink droplets from each group of nozzles (FIG. 2, 205). In one example, each of the nozzles (FIG. 2, 205) in each group of nozzles (FIG. 2, 205) may fire a single droplet (FIG. 1, 135) of ink simultaneously. Each group of nozzles (FIG. 2, 205) may fire their respective nozzles (FIG. 2, 205) one group at a time. In another example, each of the nozzles (FIG. 2, 205) in each group of nozzles (FIG. 2, 205) may fire a number of droplets (FIG. 1, 135). The processor (FIG. 1, 105) may control how many droplets (FIG. 1, 135) are to be fired from any individual nozzle (FIG. 2, 205) and record the number of firings in the storage device (FIG. 1, 150) during this method (300).

In yet another example, each of the nozzles (FIG. 2, 205) in each group of nozzles (FIG. 2, 205) may fire a single droplet (FIG. 1, 135) of ink successively instead of simultaneously. In this example, each nozzle (FIG. 2, 205) within the group of nozzles (FIG. 2, 205) may fire after a time delay of around 10 μs from the firing time of another nozzle (FIG. 2, 205). If, for example the fluid detector (FIG. 1, 120) detects ink droplets (FIG. 1, 135) within roughly a 1 ms timeframe, a number of ink droplets (FIG. 1, 135) may be detected if each ink droplet (FIG. 1, 135) were to be fired successively with a 10 μs between each firing. In this case, the amount of light received at the light detector (FIG. 1, 145) from each ink droplet (FIG. 1, 135) may be combined into a single signal.

The method (300) proceeds with the processor (FIG. 1, 105) directing the fluid detector (FIG. 1, 120) to measure (310) the ink output from each group of nozzles (FIG. 2, 205). As discussed above, the fluid detector (FIG. 1, 120) may measure the reflected light from the group of droplets (FIG. 1, 135) ejected from the group of nozzles (FIG. 2, 205). The increased amount of ink ejected from the group of nozzles (FIG. 2, 205) provides for a larger signal-to-noise ratio at the droplets (FIG. 1, 135) and more specifically at the light detector (FIG. 1, 145) of the fluid detector (FIG. 1, 120). The increased signal strength as well as the increased signal-to-noise ratio allows the printing system (FIG. 1, 100) to better detect whether a number of nozzles (FIG. 2, 205) from any group of nozzles (FIG. 2, 205) is underperforming or is defective. Additionally, by grouping a number of nozzles (FIG. 2, 205) together, the method (300) of detecting a defective nozzle may take relatively less time to complete allowing a user of the printing system (FIG. 1, 100) to use the printing system (FIG. 1, 100) relatively earlier.

After the fluid detector (FIG. 1, 120) has measured (310) the output of ink from each group of nozzles (FIG. 2, 205), the processor (FIG. 1, 105) may regroup (315) each nozzle within a group of nozzles whose output is detected as not being commensurate with the amount of ink that should be ejected from that group, individually with a number of known non-defective nozzles to form a number of subsequent groups. In this case, the known non-defective nozzles are known to be non-defective from the measurements taken by the fluid detector. Therefore, the term "known non-defective nozzle" in the present specification is meant to be understood broadly as a nozzle that has been discovered via a fluid detector (FIG. 1, 120) and flagged by the processor (105) to be ejecting the appropriate amount of fluid it was designed to eject.

If the amount of ink ejected from the group of nozzles (FIG. 2, 205) by the fluid detector (FIG. 1, 120) is commensurate with the amount of ink each group of nozzles (FIG. 2, 205) should be ejecting, the processor (FIG. 1, 105) may set a flag to that group of nozzles (FIG. 2, 205) indicating that each of those nozzles (FIG. 2, 205) in that group are not defective. If, however, the processor (FIG. 1, 105) determines, via the fluid detector (FIG. 1, 120), that the amount of ink ejected from the group of nozzles (FIG. 2, 205) is not commensurate with the amount of ink each group of nozzles (FIG. 2, 205) should be ejecting, the processor (FIG. 1, 105) may regroup (315) each nozzle (FIG. 2, 205) in the group of nozzles (FIG. 2, 205) with another nozzle (FIG. 2, 205) to form a number of subsequent groups of nozzles (FIG. 2, 205). The nozzles (FIG. 2, 205) used to create the subsequent groups are known to be working properly.

In this case, the method (300) may continue with the processor (FIG. 1, 105), via the fluid detector (FIG. 1, 120), measuring (320) ink output from the subsequent groups of nozzles to determine which nozzle among the subsequent groups of nozzles is defective. The method allows the processor (FIG. 1, 105) to determine which nozzle (FIG. 2, 205) within the nozzle array (200) is defective by disregarding those nozzles (FIG. 2, 205) that are known to be working properly and, by process of elimination, discovering which nozzle (FIG. 2, 205) is the defective nozzle (FIG. 2, 205).

Figure 4:
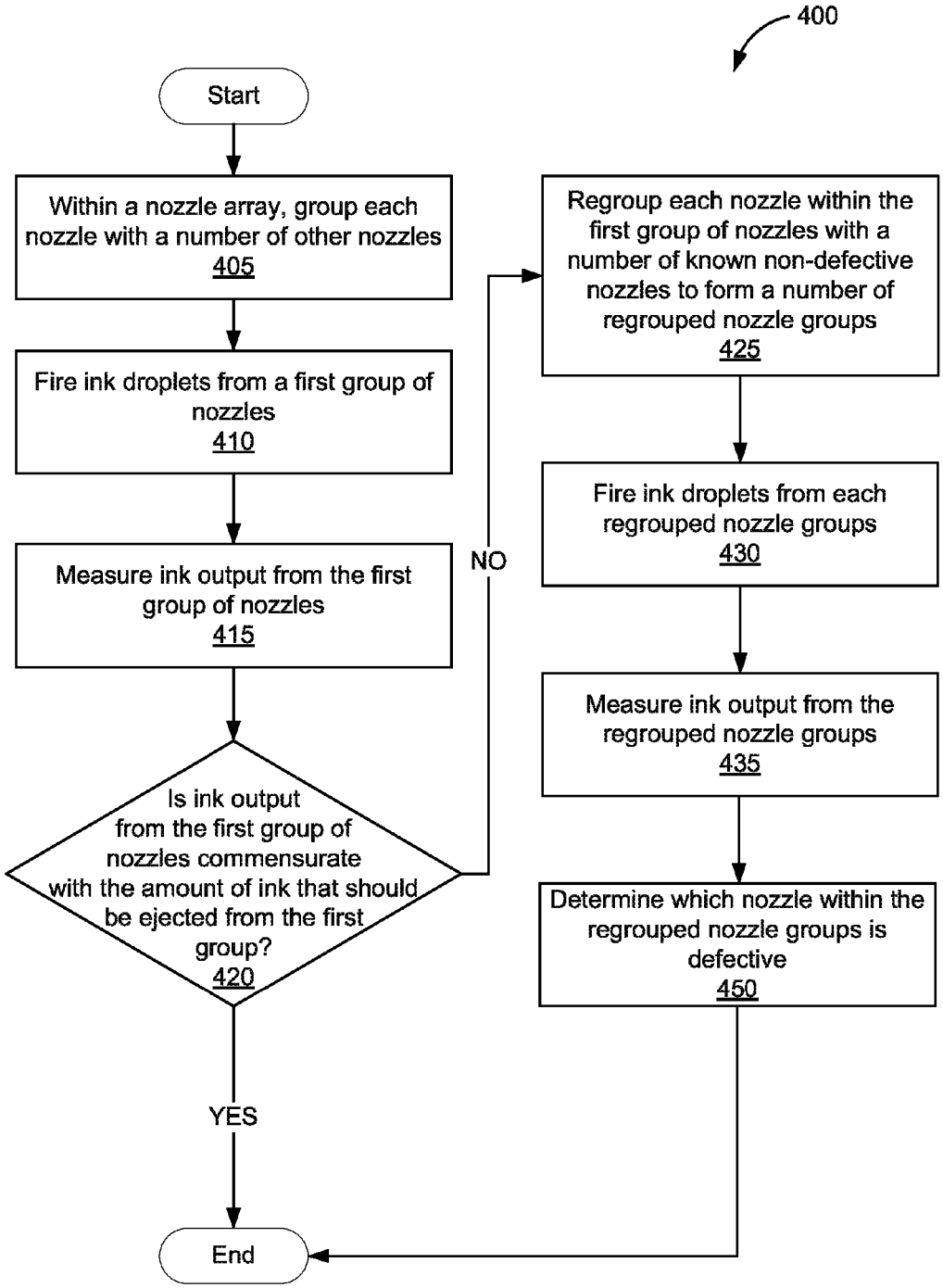
FIG. 4 is a flowchart showing another method of detecting a defective nozzle according to one example of principles described herein.

FIG. 4 is a flowchart showing another method (400) of detecting a defective nozzle according to one example of principles described herein. The method (400) may begin similar to that shown in FIG. 3 with grouping (405) each nozzle (FIG. 2, 205) with a number of other nozzles (FIG. 2, 205) within a nozzle array (FIG. 2, 200) and firing (410) ink droplets from a first group of nozzles (FIG. 2, 205) among the number of groups formed. The method (400) proceeds with the processor (FIG. 1, 105) directing the fluid detector (FIG. 1, 120) to measure (310) the ink output from the first group of nozzles (FIG. 2, 205).

A determination (420) may then be made as to whether the ink output from the first group of nozzles (FIG. 2, 205) is commensurate with the amount of ink that should have been ejected from the first group of nozzles (FIG. 2, 205). If the processor (FIG. 1, 105), via the information received at the fluid detector (FIG. 1, 120), determines (YES, 420) that the amount of ink is commensurate with the amount of ink that should have been ejected, then the method (400) ends with the processor (FIG. 1, 105) indicating in the storage device (FIG. 1, 150) that all nozzles (FIG. 2, 205) are ejecting a proper amount of ink.

If the processor (FIG. 1, 105), via the information received at the fluid detector (FIG. 1, 120), determines (NO, 420) that the amount of ink is not commensurate with the amount of ink that should have been ejected, then the method (400) continues with the processor (FIG. 1, 105) regrouping (425) each nozzle within the first group of nozzles with a number of known non-defective nozzles to form a number of regrouped nozzle groups. The method continues with the processor (FIG. 1, 105) directing ink droplets (FIG. 1, 135) to be ejected (430) from the nozzles (FIG. 2, 205) of the regrouped groups and the fluid detector (FIG. 1, 120) measuring (435) ink output from the regrouped nozzle groups.

From the measurements, the processor (FIG. 1, 105) may determine (450) which nozzle within the regrouped nozzle groups is defective by the process of elimination. Specifically, because each nozzle (FIG. 2, 205) from the first group of nozzles (FIG. 2, 205) was grouped with a number of known non-defective nozzles (FIG. 2, 205), the processor (FIG. 1, 105) may determine that any regrouped nozzle groups that have an ink output that is not commensurate with the amount of ink that should have been ejected comprises the defective nozzle (FIG. 2, 205) previously from the first nozzle group.

As mentioned in FIGS. 3 and 4, the nozzles (FIG. 2, 205) are regrouped with known non-defective nozzles (FIG. 2, 205) from other groups of nozzles (FIG. 2, 205). These nozzles (FIG. 2, 205) are from the other groups of nozzles (FIG. 2, 205) which the processor (FIG. 1, 105) has determined were all ejecting the proper amount of ink. If no groups exist where the processor (FIG. 1, 105) has determined that all the nozzles (FIG. 2, 205) in those groups were ejecting the proper amount of ink, then the processor (FIG. 1, 105) can re regroup a number of nozzles (FIG. 2, 205) and begin the methods shown and described in FIGS. 3 and 4 again.

The grouping of the nozzles (FIG. 2, 205) in the present description include any number of nozzles (FIG. 2, 205) being grouped together. In the example where the group of nozzles (FIG. 2, 205) comprises two nozzles (FIG. 2, 205), the methods described herein may pair nozzles up based on their assigned nozzle (FIG. 2, 205) number. In one example, nozzles (FIG. 2, 205) 1 and 2 may be paired, 3 and 4 may be paired, 5 and 6 may be paired and so on until all nozzles (FIG. 2, 205) have been paired together. In the case where the nozzle array (FIG. 2, 200) comprises an odd number of nozzles (FIG. 2, 205), any leftover nozzle (FIG. 2, 205) not paired up may be joined to an already paired set of nozzles (FIG. 2, 205) to form a group of 3 nozzles (FIG. 2, 205). Each paired nozzle (FIG. 2, 205) may be determined to be defective or not using either method described above. Where a pair is deemed to be defective because the amount of ink ejected from the nozzle (FIG. 2, 205) pair is not commensurate with the amount that should have been ejected, the pair of nozzles (FIG. 2, 205) may be split up with each nozzle (FIG. 2, 205) being paired with another different nozzle (FIG. 2, 205) that is know to be non-defective. Because it may be a relatively rare event to have a defective nozzle (FIG. 2, 205) within the nozzle array (FIG. 2, 200), this example provides for a relatively quicker way to test each nozzle. As describe above, as well, larger groups may be used where three or more nozzles (FIG. 2, 205) are grouped together and tested. This too may increase the speed at which the test is conducted.

In another example, the nozzle (FIG. 2, 205) may be checked group by group after forming a pair. In this example, nozzle (FIG. 2, 205) number 1 may be initially paired with nozzle (FIG. 2, 205) number 2 and the method described in FIG. 3 may be initiated by firing ink from that pair, measuring the output and determining if the pair has output an amount of ink the is commensurate with the amount that should have been ejected. In this example, if the amount of ink is not commensurate with the amount that should have been ejected, nozzle (FIG. 2, 205) number 2 may then be paired with nozzle (FIG. 2, 205) number 3 and the firing and measuring may begin again. Here, if the amount of ink is commensurate with the amount that should have been ejected, then the processor (FIG. 1, 105) may conclude that nozzle (FIG. 2, 205) number 1 is the defective nozzle (FIG. 2, 205) and flag that nozzle (FIG. 2, 205) as defective in the storage device (FIG. 1, 150). This may continued with every neighboring nozzle throughout nozzle array (FIG. 2, 200) until all of the nozzles (FIG. 2, 205) have been checked.

In one example, the methods described above may be accomplished by a computer program product comprising a computer readable storage medium having computer usable program code embodied therewith that, when executed by the processor (105) of the printing system (100) or another processing device, performs the above methods. Specifically, the computer usable program code, when executed by a processor (105), causes the processor (105) to, within a nozzle array (FIG. 2, 200), group (FIG. 3, 305; FIG. 4, 405) each nozzle (FIG. 2, 205) with a number of other nozzles (FIG. 2, 205). Additionally, the computer readable storage medium may comprise computer usable program code that, when executed by the processor (105), measures (FIG. 3, 310; FIG. 4, 415) ink output from each group of nozzles. The computer readable storage medium may comprise computer usable program code that, when executed by the processor (105), fire (FIG. 4, 410) ink droplets from a first group of nozzles (FIG. 2, 205).

In one example, the computer readable storage medium may also comprise computer usable program code that, when executed by the processor (105), regroups (FIG. 3, 315) each nozzle (FIG. 2, 205) within a group of nozzles (FIG. 2, 205) whose output is detected as not being commensurate with the amount of ink that should be ejected from that group, individually with a number of known non-defective nozzles (FIG. 2, 205) to form a number of subsequent groups. In this example, the computer readable storage medium may also comprise computer usable program code that, when executed by the processor (105), measure (FIG. 3, 320) ink output from the subsequent groups of nozzles to determine which nozzle among the subsequent groups of nozzles is defective.

In another example, the computer readable storage medium may also comprise computer usable program code that, when executed by the processor (105), determines (FIG. 4, 420) whether ink output from a first group of nozzles (FIG. 2, 205) is commensurate with the amount of ink that should be ejected from the first group of nozzles (FIG. 2, 205). In this example, the computer readable storage medium may comprise computer usable program code that, when executed by the processor (105), regroups (FIG. 4, 425) each nozzle (FIG. 2, 205) within the first group of nozzles (FIG. 2, 205) with a number of known non-defective nozzles (FIG. 2, 205) to form a number of regrouped nozzle groups. Still further the computer readable storage medium in this example may comprise computer usable program code that, when executed by the processor (105), fires (FIG. 4, 430) ink droplets from each regrouped nozzle groups, measures (FIG. 4, 435) ink output from the regrouped nozzle groups, and determines (FIG. 4, 450) which nozzle within the regrouped nozzle groups is defective.

The specification and figures describe methods of detecting a defective nozzle within a nozzle array and the printing system on which the methods may be executed on. This method of detecting defective nozzles may have a number of advantages, including providing a printing system with the ability to detect smaller amounts of fluid ejected from the nozzles. Additionally, the methods and systems described herein allows for the ability to better detect those fluids ejected from the nozzles that may not be able to be detected by, for example, a back scattering fluid detector. Back scattering fluid detectors may have a relatively more difficult time detecting black inks, for example, that are ejected from the nozzles. The present methods described herein therefore provide for the ejection of ink from a group of nozzles simultaneously. This is done so as to increase the signal-to-noise ratio at the BDD or other detector.

Still further, the methods and system described above allow for a relatively higher throughput when initiating the defective nozzle detection methods. By pairing up or grouping a number of nozzles together, the system may quickly determine which pairs or groups of nozzles comprise a defective nozzle and the test each nozzle within that group in another group of known non-defective nozzles.

Additionally, the present methods avoid having to redesign a new sensor. As described, the fluid droplets ejected from the nozzles may be significantly small such that a new or more robust detector may need to be developed to be more sensitive in order to collect a stronger signal. With the present method, however, the need to develop such detectors can be avoided.

Even further, the methods are scalable with any type of printhead. No precision alignment should have to be used while executing the above described methods on the printing system. The cost to implement this is also significantly reduced because the methods may be implemented as a change in/addition to the computer program code of the printing system. In one example, paper need not be used during the implementation of the above methods thereby saving on paper costs for a user as well.

The preceding description has been presented to illustrate and describe examples of the principles described. This description is not intended to be exhaustive or to limit these principles to any precise form disclosed. Many modifications and variations are possible in light of the above teaching.

What is claimed is:

1. A method of detecting a defective nozzle within a nozzle array comprising:

grouping each nozzle with a number of other nozzles within the nozzle array;

measuring fluid output from each group of nozzles with a fluid detector;

individually regrouping each nozzle within a group of nozzles whose fluid output is detected as not being commensurate with the amount of fluid that should be ejected from that group with a number of known non-defective nozzles to form a number of subsequent groups; and measuring fluid output from the subsequent groups of nozzles to determine which nozzle among the subsequent groups of nozzles is defective.

2. The method of claim 1, in which the fluid comprises an ink.

3. The method of claim 1, in which the number of other nozzles grouped with each nozzle is a single nozzle such that each nozzle is paired with a single nozzle.

4. The method of claim 3, in which:

each nozzle in the nozzle array is assigned a number by a processor, and each paired nozzle is paired with a nozzle that is physically neighboring the paired nozzle.

5. The method of claim 1, in which grouping each nozzle with a number of other nozzles within the nozzle array comprises:

grouping a first nozzle within the nozzle array with a physically neighboring nozzle;

measuring fluid output from the first and neighboring nozzles with a fluid detector; and regrouping the neighboring nozzle with a subsequent neighboring nozzle and measuring fluid output from the neighboring and subsequent neighboring nozzles with a fluid detector.

6. The method of claim 1, in which measuring fluid output from each group of nozzles with a fluid detector comprises ejecting fluid simultaneously from each nozzle in each group of nozzles, each group of nozzles at a time.

7. The method of claim 1, in which measuring fluid output from each group of nozzles with a fluid detector comprises ejecting fluid successively from each nozzle in each group of nozzles, each group of nozzles at a time.

8. The method of claim 1, in which the fluid detector is a backscatter drop detector (BDD).

9. A method of detecting a defective nozzle associated with a printing system comprising:

within a nozzle array, grouping each nozzle with a number of other nozzles;

firing fluid droplets from a first group of nozzles;

measuring fluid output from the first group of nozzles;

determining whether fluid output from the first group of nozzles is commensurate with the amount of fluid that should be ejected from the first group; and when it has been determined that fluid output from the first group of nozzles is not commensurate with the amount of fluid that should be ejected from the first group:

regrouping each nozzle within the first group of nozzles with a number of known non-defective nozzles to form a number of regrouped nozzle groups;

firing ink droplets from each regrouped nozzle groups;

measuring ink output from the regrouped nozzle groups; and determining which nozzle within the regrouped nozzle groups is defective.

10. The method of claim 9, in which the fluid comprises an ink.

11. The method of claim 9, in which the number of other nozzles grouped with each nozzle is one such that each nozzle is paired with a single nozzle.

12. The method of claim 9, in which grouping each nozzle with a number of other nozzles comprises:

grouping a first nozzle with a single physically neighboring nozzle; and regrouping each nozzle within the first group of nozzles with a number of known non-defective nozzles to form a number of regrouped nozzle groups comprises:

grouping the neighboring nozzle with a subsequent physically neighboring nozzle.

13. The method of claim 9, in which measuring fluid output from the first group of nozzles comprises ejecting fluid simultaneously from each nozzle in the first group of nozzles.

14. The method of claim 9, in which measuring ink output from the regrouped nozzle groups comprises ejecting fluid simultaneously from each nozzle in regrouped nozzle groups, each regrouped nozzle group at a time.

15. The method of claim 9, in which the fluid detector is a backscatter drop detector (BDD).

16. A computer program product for detecting defective nozzles within a nozzle array, the computer program product comprising:

a computer readable storage medium comprising computer usable program code embodied therewith, the computer usable program code comprising:

computer usable program code to, when executed by a processor, group each nozzle with a number of other nozzles within the nozzle array;

computer usable program code to, when executed by a processor, measure fluid output from each group of nozzles with a fluid detector;

computer usable program code to, when executed by a processor, individually regroup each nozzle within a group of nozzles whose fluid output is detected as not being commensurate with the amount of fluid that should be ejected from that group with a number of known non-defective nozzles to form a number of subsequent groups; and computer usable program code to, when executed by a processor, measure fluid output from the subsequently regrouped groups of nozzles to determine which nozzle among the subsequently regrouped groups of nozzles is defective;

in which measuring ink output from the subsequently regrouped groups of nozzles comprises ejecting fluid simultaneously from each nozzle in regrouped nozzle groups, each regrouped nozzle group at a time.

17. The computer program product of claim 16, in which measuring fluid output from each group of nozzles with a fluid detector comprises ejecting fluid simultaneously from each nozzle in each group of nozzles, each group of nozzles at a time.

18. The computer program product of claim 16, in which the fluid detector is a backscatter drop detector (BDD).

* * * * *